US005190681A

United States Patent [19]

Strepparola et al.

[11] Patent Number: 5,190,681

[45] Date of Patent: Mar. 2, 1993

[54] ANTIRUST ADDITIVES FOR LUBRICANTS OR GREASES BASED ON PERFLUOROPOLYETHERS

[75] Inventors: Ezio Strepparola, Treviglio; Piero Gavezotti; Costante Corti, both of Milan, all of Italy

[73] Assignee: Ausimont S.r.l., Milan, Italy

[21] Appl. No.: 715,692

[22] Filed: Jun. 17, 1991

Related U.S. Application Data

[63] Continuation of Ser. No. 335,227, Apr. 10, 1989, abandoned.

[30] Foreign Application Priority Data

Apr. 13, 1988 [IT] Italy ..... 20183 A/88

[51] Int. Cl.[5] ..... C10M 147/04

[52] U.S. Cl. ..... 252/51.5 R; 252/54; 252/58; 252/51; 558/447; 558/461

[58] Field of Search ..... 252/51.5 R, 54, 475; 558/447, 461

[56] References Cited

U.S. PATENT DOCUMENTS

| | | | |
|---|---|---|---|
| 3,293,306 | 12/1966 | LeBleu et al. | 252/54 |
| 3,367,868 | 2/1968 | Skehan | 252/51.5 R |
| 3,505,411 | 4/1970 | Rice | 558/447 |
| 3,536,624 | 10/1970 | Christian et al. | 252/54 |
| 3,665,041 | 5/1972 | Sianesi et al. | 252/54 |
| 3,697,564 | 10/1972 | Anello et al. | 558/447 |
| 3,847,978 | 11/1974 | Sianesi et al. | 558/447 |
| 4,011,255 | 3/1977 | Tamborski | 558/447 |
| 4,058,469 | 11/1977 | Hoke | 252/51.5 R |
| 4,085,137 | 4/1978 | Mitsch et al. | 260/561 HL |
| 4,113,772 | 9/1978 | Lagow et al. | 562/583 |
| 4,132,660 | 1/1979 | Christian et al. | 252/51.5 R |
| 4,194,983 | 3/1980 | Paciorek et al. | 252/49.9 |
| 4,404,377 | 9/1983 | Seale et al. | 544/87 |
| 4,647,413 | 3/1987 | Savu | 558/447 |
| 4,757,145 | 7/1988 | Caporiccio et al. | 252/51.5 R |

*Primary Examiner*—Ellen McAvoy
*Attorney, Agent, or Firm*—Morgan & Finnegan

[57] ABSTRACT

An antirust additive for lubricants based on perfluoropolyethers, comprising one of the fluoropolyether compounds having functionalized end groups selected from —CN, —$CH_2NR_1R_2$ and

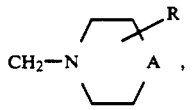

and in particular a combination of these with small amounts of a fluoropolyether with acid end groups.

5 Claims, No Drawings

ANTIRUST ADDITIVES FOR LUBRICANTS OR GREASES BASED ON PERFLUOROPOLYETHERS

This is a continuation of co-pending application Ser. No. 07/335,227, filed on Apr. 10, 1989, now abandoned.

FIELD OF THE INVENTION

This invention relates to functionalized fluoropolyether compounds which impart antirust properties to lubricating oils and greases based on perfluoropolyethers.

BACKGROUND OF THE INVENTION

It is known that the utilization of perfluoropolyethers as lubricants does not prevent the formation of rust on the surface of ferrous materials even if they are coated with an oil film, when moisture is present. The reason resides in the high permeability to gases, to vapors, and among these also water vapor, exhibited by perfluoropolyethers (PFPE).

PFPE utilizable for formulating lubricating oils and greases are broadly known on the market, such as, e.g., FOMBLIN® (produced by Montedison), KRYTOX® (produced by DuPont), DENNUM® (produced by Daikin), and the like.

As is well known, PFPE's are very difficult to enter into addition reactions, because a characteristic thereof is the absolute immiscibility with most chemical compounds. This in turn makes it impossible to use as additives the products which are usually employed for mineral oils traditionally utilized as lubricants and which, conversely, can easily enter into addition reactions, thus giving rise to mixtures which are sufficiently stable in the long run.

DETAILED DESCRIPTION OF THE INVENTION

The compounds according to the present invention exhibit marked improvement as regards antirust protection with respect to the anticorrosive products cited in European patent applications Nos. 95,825, 165,649 and 165,650 and in Italian patent application No. 20,159 A/86.

In particular, the additives described in Italian patent application No. 20,159 A/86 which have exhibited high antirust properties are:

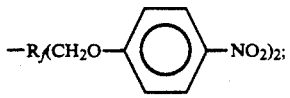

(1)

$$\left\{\begin{array}{l} R_f(CH_2OH)_2 \\ R_f(COOH)_2; \text{ and} \end{array}\right. \quad (2)$$

$$\left\{\begin{array}{l} R_f(CH_2OCH_2COOC_2H_5)_2 \\ R_f(COOH)_2 \end{array}\right. \quad (3)$$

wherein $R_f = -CF_2R_f'CF_2$, where $R_f'$ is a perfluoropolyether chain having an average molecular weight of 2,000 and belonging to class I.

However, additives 1 and 3 indicated hereinbefore exhibit the drawback of being only slightly soluble in the lubricating perfluoropolyether, which gives rise to problems concerning phase separation, while additive 2, although it is endowed at the beginning with an acceptable solubility, in the course of time gives rise to a certain amount of ester compound. This causes the mass to become cloudy and tends to form an overfloating layer, wherefore the additive separates from the lubricant.

Thus, a need existed for compounds capable of imparting, to the lubricants to which they are additioned, not only high antirust properties, but also a high "shelf-life" (solubility of the additive retained in the course of time). This is absolutely necessary for marketing the product.

It has, surprisingly, been discovered (in accordance with the present invention) that the above desirable properties are obtainable if use is made, as an additive, of a perfluoropolyether having one or more of the following repeating units:

$(C_2F_4O)$, $(CF_2O)$, $(C_3F_6O)$, $(CH_2CF_2CF_2O)$, $(CF_2O-CF_2CF_2O)$, and

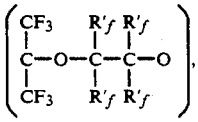

where $R'_f$ is a fluoroalkyl radical, and having at least an end group selected from:

(a) $-CFX-CN$;

(b) $-CFX-CH_2-NR_1R_2$, where $R_1$ and $R_2$, alike or different from each other, may be H, alkyl with 1 to 8 carbon atoms, alkyl-aryl with 7 to 11 carbon atoms, cycloalkyl with 6 to 10 carbon atoms, optionally substituted by alkyl with 1 to 3 carbon atoms; $R_1$ and $R_2$ optionally containing herteroatoms selected from O, N, S; and (c)

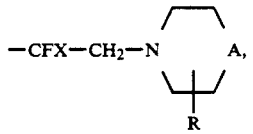

where A=O, N or S, and R is H or an alkyl with 1 to 3 carbon atoms;

where X in (a), (b) and (c) is F or $CF_3$; and the other end group T or T' may be a perfluoroalkyl radical with 1 to 3 carbon atoms.

In particular, the antirust additives of the present invention are those belonging to the following classes:

$$TO(CF_2CF_2O)_n(CF_2O)_mT'; \quad (I)$$

$$TO(CF_2CF_2O)_k(CF_2O)_j\left(CF_2\underset{\underset{CF_3}{|}}{C}FO\right)_p\left(\underset{\underset{CF_3}{|}}{C}FO\right)_qT'; \quad (II)$$

$$TO(CF_2CF_2CF_2O)_sT'; \quad (III)$$

$$T(OCF_2CF_2CH_2)_rOR_fO(CH_2CF_2CF_2O)_tT'; \quad (IV)$$

$$TO(CF_2CF_2O)_vT'; \quad (V)$$

$$T\left(OCF_2\underset{\underset{CF_3}{|}}{C}F\right)_uOR_fO\left(\underset{\underset{CF_3}{|}}{C}F-CF_2O\right)_uT'; \quad (VI)$$

-continued $$TO(CF_2\underset{\underset{CF_3}{|}}{C}FO)_y(CFXO)_zT' \text{ where } X = F \text{ or } CF_3; \quad (VII)$$

$$TO(CF_2\underset{\underset{CF_3}{|}}{C}FO)_xT'; \quad (VIII)$$

$$T(OCF_2CF_2CH_2)_yOT'; \quad (IX)$$

$$TO\left(\underset{\underset{CF_3}{|}}{C}-O-\underset{\underset{R'_f}{|}}{\underset{\underset{R'_f}{|}}{C}}-C-O\right)_gT'; \text{ or} \quad (X)$$

$$TO(CF_2O-CF_2CF_2O)_hT'; \quad (XI)$$

where at least one of end groups T and T' is selected from (a) —CFX—CN;

(b) —CFX—$CH_2$—$NR_1R_2$, where $R_1$ and $R_2$ are the same as defined above;

(c)

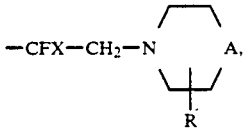

where A and R are the same as defined hereinbefore;

where X in (a), (b) and (c) is F or $CF_3$;

the other end group T or T' may be a perfluoroalkyl radical with 1 to 3 carbon atoms;

indexes g, h, m, n, k, j, p, q, s, t, r, u, v, z, x, y are integers selected in such manner that the average molecular weight of the polyoxyfluoroalkylene chain ranges from 600 to 6,000, and preferably from 2,000 to 4,000 for difunctional compounds and from 1,000 to 2,000 for monofunctional compounds;

$R_f$ is a fluoroalkylene radical;

$R'_f$ is a fluoroalkyl radical;

the oxyfluoroalkylene units being statistically distributed along the chain.

Generally, the additives of this invention exhibit a solubility in the PFPE lubricant of at least 1% by weight referred to the lubricant. The amount of the above antirust fluoropolyether additives preferably ranges from 1% to 5% by weight based on the total amount of lubricant, and more preferably from 2% to 4%.

If the lubricant in which the antirust additive is utilized is a grease based on perfluoropolyether, this may be prepared as is described in European patent application No. 92,825. In particular, such grease may be formulated by suspending polytetrafluoroethylene particles, having for example a spherical morphology and being composed of aggregates having sizes from 1 to 200 microns, in a perfluoropolyether liquid such as Fomblin ®Y or Fomblin ® Z.

The compounds having end groups of the types (b) and (c) indicated above may also be utilized as such in consideration of their intrinsic lubricating properties.

Furthermore, it has been discovered that the additives having the end groups (a), (b) and (c) indicated above may be used in combination with small amounts of fluoropolyether compounds having the same chain structure as the compounds belonging to classes I through XI and one or two end groups —CFX—COOH, where X is F or $CF_3$, generally in an amount ranging from 1/30 to 1/20 by weight of the additive characterized by end groups (a), (b) or (c).

The precursors having a fluoropolyether structure of the additives of the present invention are preparable as follows:

those of class (I) according to the processes described in U.S. Pat. No. 3,242,218;

those of class (II) according to U.S. Pat. No. 3,665,041;

those of classes (III) and (IV) according to published European patent application EP 148,482;

those of class (V) according to U.S. Pat. No. 4,523,039;

those of class (VI) according to published European patent application EP 151,877;

those of class (VII) according to U.S. Pat. No. 3,665,041;

those of class (VIII) according to U.S. Pat. No. 3,250,808;

those of class (IX) according to EP 148,482;

those of class (X) according to the processes described in International patent application WO87/00538; and those of class (XI) according to the processes described in International patent application WO87/02992.

The above end groups may be obtained by the method described in U.S. Pat. No. 3,010,874. In particular, the introduction of the end groups of type (a) is obtained starting from the corresponding derivatives with ester end groups —CFX—$COOR_3$ ($R_3$=$CH_3$, $C_2H_5$, $C_6H_5$) by treatment with anhydrous ammonia, preferably in a solvent such as, for example, ethyl ether, methanol, or 1,1,2-trichlorotrifluoroethane, and subsequent treatment of the resulting amide with $P_2O_5$.

The introduction of end groups of types (b) and (c) is obtained by reacting the ester compounds indicated above, respectively, with an amine $NHR_1R_2$ or with an amine having the formula:

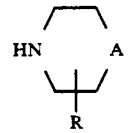

to provide the respective amides, and by subsequent reduction with hydrides.

In the case of classes (II), (III), (V), (VII), (VIII), (IX), and (X) in which the starting perfluoropolyethers have only one functional end group, it is possible to achieve the corresponding bifunctionalized product by means of the process described in European patent application EP 224,201.

The antirust properties of the additioned lubricants according to the present invention have been evaluated by means of the following tests:

Antirust test in the fog chamber

Method ASTM D.1748, modified

Object: Determination of the antirust properties of oils on metals under conditions of high humidity.

Summary of the method: carbon steel plates (C15) (UNI) - superficially treated as is described hereinafter -- were dipped into the oil, allowed to drip and hung in a fog chamber at 50° C. and 100% of relative humidity, for a pre-determined number of hours. The oil passes or does not pass the test depending upon the number of rust stains which are visible on the surface of the plates.

Apparatus: The fog chamber consists of a compressed-air-actuated sprayer (P=3 atm.), connected with a water reserve and such as to saturate the environment with humidity; the temperature check was adjusted at 50° C. (see ASTM B.117, 287, 368).

Test conditions: The tests described hereinafter were carried out using partially demineralized water (pH=5.5–7.5) for periods of time as follows:

(1) the plates were hung and allowed to drip for 16 hours;
(2) they were then placed into a fog chamber, which was kept in operation during 8 hours;
(3) the fog chamber was kept out of operation during 12 hours;
(4) the fog chamber was turned on again and kept in operation during 8 hours.

Then the evaluation was carried out.

Preparation of the steel plates: The steel plates were cleaned and degreased by means of a cloth saturated with Delifrene 113 (trichlorotrifluoroethane); the surface was polished by means of rubbing papers (400 meshes and 600″), then they were washed with water and dried. The steel plates utilized had the following dimensions: 50×100×2 mm. (Note: polythene gauntlets must be used to handle the plates.)

Evaluation of the tests: (By analogy with method DIN 51802 (EMCOR) for bearings).

The results of the tests are expressed according to the following classifications:

(0) no traces of rust are observed;
(1) very few corrosion points having a diameter below 1 mm;
(2) 30% of the surface is covered by little stains having a diameter below 2 mm;
(3) 60% of the surface is covered by little stains having a diameter below 3 mm;
(4) 100% of the surface is covered by large stains having a diameter of 4–5 mm, but the polished surface is visible in some points;
(5) 100% of the surface is covered by large stains; the underlying surface is not visible.

In the evaluation, the rust stains appearing in the area up to 0.5 mm from the edges are not taken into consideration. If the evaluation is (0), the test has been met.

In the evaluation, two figures are indicated: the first figure refers to the state of the exposed face; the second figure refers to the non-exposed face (with respect to the sprayer).

EXAMPLES

The following examples are given to illustrate the present invention, without however being a limitation thereof.

EXAMPLE 1

Lubricants consisting of perfluoropolyether having perfluoroalkyl end groups Fomblin® Y25, characterized by a viscosity of 250 cSt at 20° C., additioned with the compounds indicated in the following Table 1, were subjected to the accelerated corrosion test in a fog chamber according to the method described above.

Table 1 shows the weight % of the additive with respect to the perfluoropolyether and the results of the corrosion test, expressed by the indices reported above in the description of the method.

TABLE 1

Tests on Fomblin® Y25

| Additive | | M.W. | Weight % | Result |
|---|---|---|---|---|
| (a) | $NC-CF_2O(CF_2CF_2O)_m(CF_2O)_n-CF_2CN$ | 2000 | 2 | 0–0 |
| | $HOOC-CF_2O(CF_2CF_2O)_m(CF_2O)_n-CF_2COOH$ | 2000 | 0.1 | |
| (b) | $NC-CF_2O(CF_2CF_2O)_m(CF_2O)_n-CF_2CN$ | 2000 | 3 | 0–0 |
| | $HOOC-CF_2O(CF_2CF_2O)_m(CF_2O)_n-CF_2COOH$ | 2000 | 0.1 | |
| (c) | $NC-CF_2O(CF_2CF_2O)_m(CF_2O)_n-CF_2CN$ | 2000 | 2 | 0–0 |
| (d) | 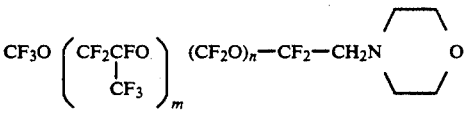 | 1000 | 2 | 0–0 |
| (e) | 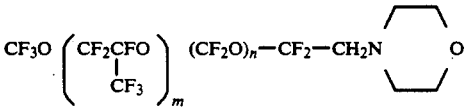 | 1000 | 5 | 0–0 |
| (f) | $CF_3O\left(CF_2\underset{\vert}{C}FO\right)_m(CF_2O)_n-CF_2CH_2NH_2$ ($CF_3$) | 900 | 2 | 1–0 |
| (g) | $CF_3O\left(CF_2\underset{\vert}{C}FO\right)_m(CF_2O)_n-CF_2CH_2NH_2$ ($CF_3$) | 900 | 4 | 0–0 |

EXAMPLE 1A

Example 1 was repeated using, as a lubricant, non-additived perfluoropolyether Fomblin ® Y25. The result was a complete corrosion of the plate: 5—5.

EXAMPLE 1B

Example 1 was repeated using, as a lubricant, Fomblin ®Y25 additived with the mixture:

$$CH_2{=}CH{-}CH_2OCH_2CF_2O(CF_2CF_2O)_m(CF_2O)_nCF_2CH_2OCH_2CH{=}CH_2$$

M.W. = 2,000; 2% and $$HOOC{-}CF_2O(CF_2CF_2O)_m(CF_2O)_n{-}CF_2COOH$$

M.W. = 2,000; 0.1% soluble in the perfluoropolyether.

The result of the test was 3-2.

EXAMPLE 2

Lubricants consisting of perfluoropolyether having perfluoroalkyl end groups Fomblin ® Z25, characterized by a viscosity of 250 cSt at 20° C., additived with the compounds reported in the following Table 2, were subjected to the accelerated corrosion test as in Example 1.

Table 2 shows the results of the tests.

TABLE 2

| Additive | Tests on Fomblin ® Z25 | M.W. | Weight % | Result |
|---|---|---|---|---|
| (a) | $NC{-}CF_2O(CF_2CF_2O)_m(CF_2O)_n{-}CF_2CN$ | 2000 | 2 | 0–0 |
| | $HOOC{-}CF_2O(CF_2CF_2O)_m(CF_2O)_n{-}CF_2COOH$ | 2000 | 0.1 | |
| (b) | $NC{-}CF_2O(CF_2CF_2O)_m(CF_2O)_n{-}CF_2CN$ | 2000 | 3 | 0–0 |
| | $HOOC{-}CF_2O(CF_2CF_2O)_m(CF_2O)_n{-}CF_2COOH$ | 2000 | 0.1 | |

EXAMPLE 2A

Example 2 was repeated using, as a lubricant, non-additived perfluoropolyether Fomblin ® Z25. The result was a complete corrosion of the plate: 5—5.

EXAMPLE 2B

Example 2 was repeated using, as a lubricant, Fomblin ®Z25 additived with the mixture:

$$\begin{cases} CH_2{=}CH{-}CH_2OCH_2CF_2O(CF_2CF_2O)_m(CF_2O)_nCF_2CH_2OCH_2CH{=}CH_2 \\ \text{M.W. 2,000; 2\%} \\ HOOC{-}CF_2O(CF_2CF_2O)_m(CF_2O)_n{-}CF_2COOH \\ \text{M.W. 2,000; 0.1\%.} \end{cases}$$

The result of the test was a rather good anticorrosive power (2-0), but the additive was insoluble in this type of perfluoropolyether.

EXAMPLE 3

Subjected to the accelerated corrosion test as in Example 1 were the lubricants consisting of perfluoropolyether having perfluoroalkyl end groups Fomblin ® YR 140/13, characterized by a viscosity of 1,400 cSt at 20° C., additived with the mixture:

$$\begin{cases} NC{-}CF_2O(CF_2CF_2O)_m(CF_2O)_nCF_2CN & 2{,}000 & 3\% \\ HOOC{-}CF_2O(CF_2CF_2O)_m(CF_2O)_n{-}CF_2COOH & 2{,}000 & 0.1\% \end{cases}$$

The result of the corrosion test was 0—0.

EXAMPLE 3A

Example 3 was repeated using, as a lubricant, perfluoropolyether Fomblin ® YR 140/13 without additive. The result was a complete corrosion of the plate: 5—5.

EXAMPLE 3B

Example 3 was repeated using, as a lubricant, Fomblin ® YR 140/13 additived with the mixture:

$$CH_2{=}CH{-}CH_2OCH_2CF_2O(CF_2CF_2O)_m(CF_2O)_nCF_2CH_2OCH_2CH_2{=}CH_2$$

M.W. = 2,000; 2% and $$HOOC{-}CF_2O(CF_2CF_2O)_m(CF_2O)_n{-}CF_2COOH$$

M.W. = 2,000; 0.1%.

The result of the test was a rather good anticorrosive power (1-0), but the additive was insoluble in this type of perfluoropolyether.

Although the invention has been described in conjunction with specific embodiments, it is evident that many alternatives and variations will be apparent to those skilled in the art in light of the foregoing description. Accordingly, the invention is intended to embrace all of the alternatives and variations that fall within the spirit and scope of the appended claims. The above references are hereby incorporated by reference.

What is claimed is:

1. Antirust additives for greases and lubricating oils based on perfluoropolyethers, consisting of fluoropolyether compounds having at least one of the following repeating units:

$(C_3F_6O)$, $(CH_2CF_2CF_2O)$, and

-continued $$\left(\begin{array}{ccccccc} CF_3 & & R'_f & & R'_f & & \\ | & & | & & | & & \\ C & - & O & - & C & - & C - O \\ | & & | & & | & & \\ CF_3 & & R'_f & & R'_f & & \end{array}\right), \text{ where } R'_f \text{ is}$$

a fluoroalkylene radical, and having at least one end group of formula:

—CFX—CN;

where X is F or $CH_3$; and the other radical may be a perfluoroalkyl radical having 1 to 3 carbon atoms.

2. Antitrust additives for greases and lubricating oils based on perfluoropolyethers, comprising at least one of the following fluoropolyether compounds:

$$TO(CF_2CF_2O)_k(CF_2O)_j\left(\begin{array}{c} CF_2CFO \\ | \\ CF_3 \end{array}\right)_p\left(\begin{array}{c} CFO \\ | \\ CF_3 \end{array}\right)_q T'; \quad \text{(I)}$$

$$TO(CF_2CF_2CF_2O)_sT'; \quad \text{(II)}$$

$$T(OCF_2CF_2CH_2)_tOR_fO(CH_2CF_2CF_2O)_iT'; \quad \text{(III)}$$

$$TO(CF_2CF_2O)_rT'; \quad \text{(IV)}$$

$$TOCF_2\underset{\underset{CF_3\ u}{|}}{C}FOR_fOCF\underset{\underset{CF_3\ u}{|}}{C}F_2O\ T'; \quad \text{(V)}$$

$$TO(CF_2\underset{\underset{CF_3}{|}}{C}FO)_v(CFXO)_zT' \text{ where } X = F \text{ or } CF_3; \quad \text{(VI)}$$

$$TO(CF_2\underset{\underset{CF_3}{|}}{C}FO)_xT'; \quad \text{(VII)}$$

$$T(OCF_2CF_2CH_2)_yOT'; \text{ and} \quad \text{(VIII)}$$

$$TO\left(\begin{array}{ccccccc} CF_3 & & R'_f & & R'_f & & \\ | & & | & & | & & \\ C & - & O & - & C & - & C - O \\ | & & | & & | & & \\ CF_3 & & R'_f & & R'_f & & \end{array}\right)_gT'; \quad \text{(IX)}$$

where at least one of the end groups T and T' is of the formula:

—CFX—CN;

where X is F or $CF_3$;

the other end group T or T' may be a perfluoroalkyl radical having 1 to 3 carbon atoms;

indices g, k, j, p, q, s, t, r, u, v, z, x, y are positive integers selected in such manner that the average molecular weight of the polyoxyfluoroalkylene chain ranges from 600 to 6,000; $R_f$ is a fluoroalkylene radical; $R'_f$ is a fluoroalkyl radical; and the oxyfluoroalkylene units are statistically distributed along the chain;

such additives being further characterized by a solubility in the PFPE grease or lubricating oil of at least 1% by weight referred to the grease or lubricating oil.

3. Greases and lubricating oils having antitrust properties, based on perfluoropolyethers of claim 2 comprising as additives, in an amount ranging from 1 to 5% by weight calculated on the total amount of grease or lubricating oil, fluoropolyether compounds having at least one of the following repeating units:

$(C_2F_4O)$, $(CF_2O)$, $(C_3F_6O)$, $(CH_2CF_2CF_2O)$, and $$\left(\begin{array}{ccccccc} CF_3 & & R'_f & & R'_f & & \\ | & & | & & | & & \\ C & - & O & - & C & - & C - O \\ | & & | & & | & & \\ CF_3 & & R'_f & & R'_f & & \end{array}\right),$$

where $R'_f$ is a fluoroalkylene radical, and having at least one end group of formula: —CFX—CN; where X is F or $CH_3$; and the other radical may be a perfluoroalkyl radical having 1 to 3 carbon atoms.

4. The greases and lubricating oils of claim 3, wherein the additives are in an amount ranging from 2 to 4% by weight calculated on the total amount of grease or lubricating oil.

5. Greases and lubricating oils having antirust properties, based on perfluoropolyethers comprising the additives of claim 1 in combination with small amounts of fluoropolyether compounds having the same chain structure of said additives and one or two end groups —CFX—COOH, where X is F or $CF_3$, in an amount ranging from 1/30 to 1/20 by weight of the additive of claim 1.

* * * * *